United States Patent [19]

Pilat

[11] 4,193,774

[45] Mar. 18, 1980

[54] ELECTROSTATIC AEROSOL SCRUBBER AND METHOD OF OPERATION

[76] Inventor: Michael J. Pilat, 7306 57th Ave. NE., Seattle, Wash. 98115

[21] Appl. No.: 926,126

[22] Filed: Sep. 17, 1978

Related U.S. Application Data

[63] Continuation of Ser. No. 752,988, Dec. 21, 1976, abandoned, which is a continuation-in-part of Ser. No. 492,157, Jul. 26, 1974, abandoned.

[51] Int. Cl.[2] ..... B03C 3/16

[52] U.S. Cl. ..... 55/10; 55/87; 55/89; 55/107; 55/120; 55/124; 55/138; 55/227; 55/229; 55/233

[58] Field of Search ..... 55/7, 8, 10, 107, 108, 55/117, 122, 124, 126, 138, 87, 227, 229, 233, 257 R, 89, 120; 239/3, 15, 695, 706, 707; 361/227–229

[56] References Cited

U.S. PATENT DOCUMENTS

| | | | |
|---|---|---|---|
| 1,329,850 | 2/1920 | Schmidt et al. | 55/135 |
| 1,399,441 | 12/1921 | Peterson | 55/117 |
| 1,413,877 | 4/1922 | Schmidt | 55/124 |
| 2,001,700 | 5/1935 | Barthel | 55/107 |
| 2,351,089 | 6/1944 | Abbey | 55/108 |
| 2,357,354 | 9/1944 | Penney | 55/107 |
| 2,525,347 | 10/1950 | Gilman | 55/107 |
| 2,696,892 | 12/1954 | Campbell | 55/8 |
| 2,763,125 | 9/1956 | Kadusch et al. | 55/2 |
| 2,788,081 | 4/1957 | Ransburg | 55/107 |
| 2,789,658 | 4/1957 | Wintermute | 55/100 |
| 2,931,459 | 4/1960 | Wiles et al. | 55/227 |
| 2,949,168 | 8/1960 | Peterson | 55/107 |
| 3,122,594 | 2/1965 | Kielback | 55/233 |
| 3,218,781 | 11/1965 | Allemann et al. | 55/138 |
| 3,309,915 | 3/1967 | McEvental | 55/146 |
| 3,331,192 | 7/1967 | Peterson | 55/124 |
| 3,370,646 | 2/1968 | Hopper | 55/1 |
| 3,635,157 | 1/1972 | Taylor et al. | 317/3 |
| 3,773,966 | 11/1973 | Ebert et al. | 55/120 |
| 3,807,137 | 4/1974 | Rommell | 55/107 |
| 3,837,915 | 9/1974 | Erb | 317/3 |
| 3,877,898 | 4/1975 | Sakai et al. | 55/122 |
| 3,899,308 | 8/1975 | Peterson | 55/122 |
| 3,926,586 | 12/1975 | Matts | 55/122 |

FOREIGN PATENT DOCUMENTS

| | | | |
|---|---|---|---|
| 538980 | 11/1931 | Fed. Rep. of Germany | 55/128 |

*Primary Examiner*—David L. Lacey
*Attorney, Agent, or Firm*—Christensen, O'Connor, Johnson & Kindness

[57] ABSTRACT

A method and apparatus for removing entrained particulate matter from a gas stream in which the particles are charged with an electrostatic charge of one polarity, droplets of electrostatically charged liquid are sprayed into the gas stream and the resultant mixture injected into a bubble-forming mechanism wherein bubbles are formed by the gas containing the charged particulate matter and liquid droplets. The smaller mass charged particles are attracted toward and collect upon the charged spray droplets or bubbles. Liquid containing the particulate matter then is removed from the gas stream via known techniques.

22 Claims, 16 Drawing Figures

Fig. 5.
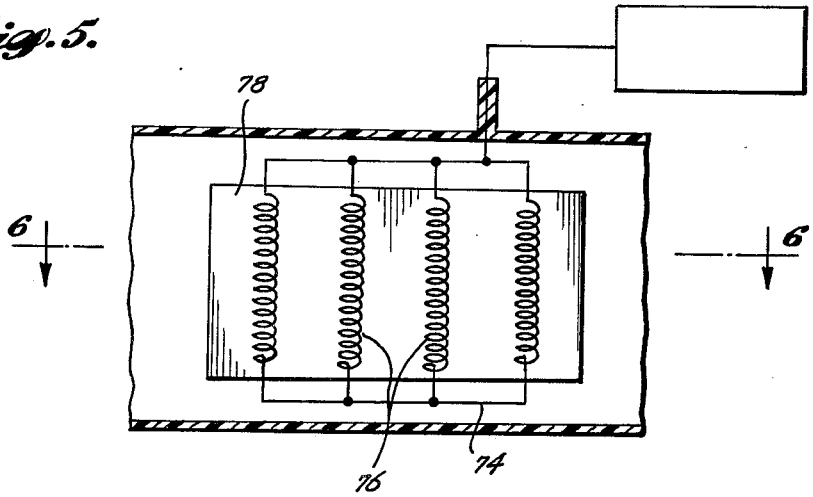
Fig. 6.
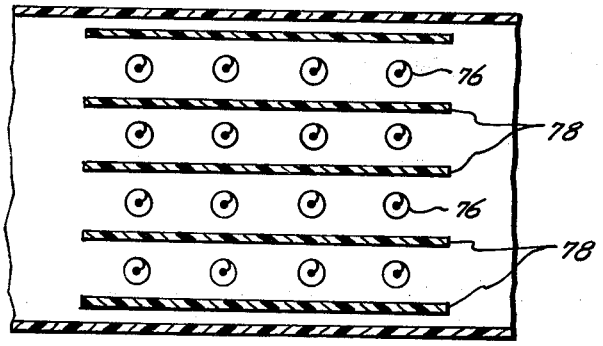
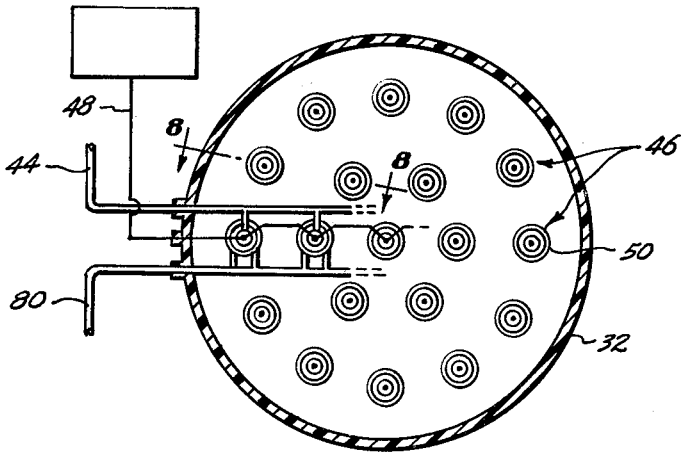
Fig. 7.
Fig. 8.
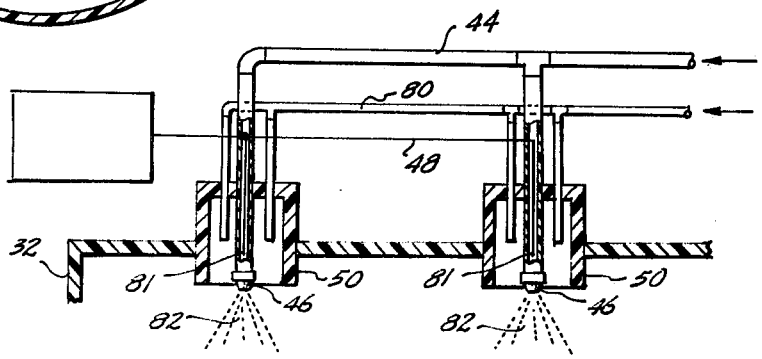

ELECTROSTATIC AEROSOL SCRUBBER AND METHOD OF OPERATION

This application is a continuation of copending application Ser. No. 752,988, filed Dec. 21, 1976, now abandoned, which in turn is a continuation-in-part of prior copending application Ser. No. 492,157, filed July 26, 1974, now abandoned, the benefits of the filing dates of which are hereby claimed under 35 USC 120.

BACKGROUND OF THE INVENTION

The cleansing of industrial exhaust gases using wet electrostatic scrubbers techniques is well-known. Such apparatus uses fine water spray droplets or cascading sheets of water in place of the conventional solid collector plates of an electrostatic precipitator. The interaction of a finely atomized water spray uniformly charged to one polarity, with an oppositely charged aerosol, creates a combined spray scrubber and collector apparatus wherein charged particles are physically captured by the water droplets or cascading sheet of water enhanced by the attraction of the charged particles toward the oppositely charged spray droplets or sheet of water. Following Coulomb's Law, the small particles are attracted toward and captured by the water droplets or sheet. Such apparatus is shown in U.S. Pat. Nos. 2,357,354 and 2,357,355, wherein an electrostatic dust precipitator utilizing liquid spray is disclosed. U.S. Pat. No. 3,331,192 discloses an electrostatic precipitator apparatus of the liquid spray type in which aerosol particles are charged to one polarity, liquid spray droplets are oppositely charged and the gas stream carrying the aerosol is contacted with the liquid spray droplets. As a result, the particulate matter migrates to the liquid spray droplets and is collected. In this device the contact between the liquid spray and the aerosol-containing gas stream is carried out in a large open container.

The well-known processes noted above, while permitting removal of relatively larger particles from a gas stream have too small and inefficient a contact between the aerosol particulate matter in the gas stream and the droplets to remove the relatively smaller particles to the extent necessary to meet current air pollution standards. This invention provides additional improvements in the contaminated aerosol charging apparatus, the liquid spray charging apparatus, the method and apparatus for contacting the charged particulate material and the oppositely charged liquid, and in the arrangement of all these improved components to create a more efficient and commercially feasible wet electrostatic scrubber and collector of aerosol particles.

OBJECTS OF THE INVENTION

It is an object of this invention to provide air pollution control equipment in which aerosol particles may be removed from a gas stream.

It is a further object of this invention to provide apparatus for separating aerosol particles from a gas stream wherein improved gas-liquid contact, enhanced by electrostatic forces, is utilized to improve collection efficiency.

It is a further object of this invention to provide a spray tower-type aerosol treatment facility connected in conjunction with a bubble-forming gas-liquid scrubbing apparatus, both of which have the performance thereof enhanced by the imposition of electrostatic charges upon the particulate and liquid components of the system.

It is a still further, and more specific, object of this invention to improve the collection efficiency obtained in prior art spray tower-type electrostatic precipitators by operating such precipitators in conjunction with a unique gas-liquid contacting device, in which intimate contact between the charged aerosol particle-containing gas stream and an electrostatically charged scrubber liquid is obtained, and in which extended residence time is provided for such contact whereby improved collection efficiency results.

SUMMARY OF THE INVENTION

The cleansing of industrial exhaust gases containing contaminating aerosol particles, such as fly ash, is undertaken more effectively, feasibly, and efficiently by an improved series of spray towers combined with a novel bubble type gas-liquid contact means using electrostatic charges to enhance the contact in which more effective scrubbing and collection occurs of contaminate aerosol particles from commercial exhaust gases.

The improvements include:

(1) enhanced charging of the aerosol particles utilizing a direct current potential between rough or smooth surface corona discharge electrodes and spaced apart non-discharge electrodes, wherein a flow of dry air is used to purge the high-voltage leads and insulators for the corona zone and to limit the aerosol particle flow into the insulator area to keep the insulator as clean as possible;

(2) an electrically isolated system constructed of insulating material, such as fiberglass reinforced polyester to retard leakage and consumption of electrical energy;

(3) more effective interaction flows of charged cleansing liquid droplets and aerosol particles are undertaken in the spray towers, by effective arrangement of the spray nozzle exits, and employment of non-metallic materials;

(4) providing bubble-forming apparatus, such as a perforated plate or preferably a multiple plate, packed tower, gas-liquid contacting apparatus which contains one or more layers of liquid bubble-forming medium, said medium having an electrostatic charge differing from that charge imposed upon the particulate matter and upon the liquid droplets. The gas containing the charged particulate matter and charged liquid droplets is caused to flow upwardly through the bubble-forming device, whereby intimate gas-liquid contact is effected by the formation of bubbles in a layer of liquid foam.

The scrubbing liquor used in the co-current or counter-current spray towers is charged via a direct charging technique and is contained within an isolated recycled-type system to minimize power consumption and to protect operating personnel from high voltage hazards. The electrically isolated system necessarily includes electrically isolated entrance means for recycled scrubber liquor and for fresh-water make-up as well as an isolation transformer for the power supply. In addition, liquid level controls are especially designed to permit complete electrical isolation of the system from its surroundings.

The method taught herein and the apparatus necessary for practice of the method can be generally described as follows: A gas stream containing aerosol particulate matter, which would otherwise constitute a source of pollution, is first transported to an electrostatic precipitator section in which the aerosol particulate matter is electrostatically charged. The charged aerosol is then contacted with a spray of cleansing liquor which has been charged to an opposite polarity to the charge carried by the aerosol particles in an open space to capture the bulk of the aerosol particles.

A portion of the droplets of cleansing liquor settle to the bottom of the open space and are collected and recycled for further use. A substantial portion of the droplets in the smaller size range is carried in the gas as a dispersion or fog and flows to an adjacent gas-liquid contacting apparatus. The gas-liquid contacting apparatus is preferably a perforated plate-type bubble-forming apparatus, a packed tower, a bubble tray or other type of gas-liquid contact apparatus which provides intimate contact between the gas and liquid. A layer of liquid is maintained above each plate so that bubbles or foam will be formed during the travel of the gas upwardly through the perforated plate or other bubble-forming device. The gas stream containing the charged aerosol particles and the injected, electrostatically charged liquid droplets is broken up into tiny parts, each surrounded by the skin of a bubble or is positioned within the interstices between bubbles. The liquid used to form the bubbles has imposed upon it an electrostatic charge differing from the charges imposed upon the spray droplets or the aerosol particles. As a consequence of the electrostatic charges on the liquid, on the aerosol particles and on the spray droplets, the aerosol particles are attracted to the droplets, the bubble skin, or both. The apparatus utilized causes bubbles to be formed and sufficient liquid is present so that a sufficient layer of foam is formed resulting in an adequate contact time between the gas and the liquid. Excellent collection efficiency results.

DESCRIPTION OF THE DRAWINGS

FIG. 5 is a schematic elevational view of an aerosol charging apparatus with one side removed for clarity;

FIG. 6 is a partial schematic plan view of the aerosol charging apparatus shown in FIG. 5 in cross section taken along lines 6—6 of FIG. 5;

FIG. 7 is a schematic plan view of a spray forming and charging apparatus used to charge cleansing liquid spray droplets in towers 120 and 134 of FIG. 1;

FIG. 8 is a partial cross section taken along lines 8—8 of FIG. 7;

DESCRIPTION OF PREFERRED EMBODIMENTS

Figure 1:
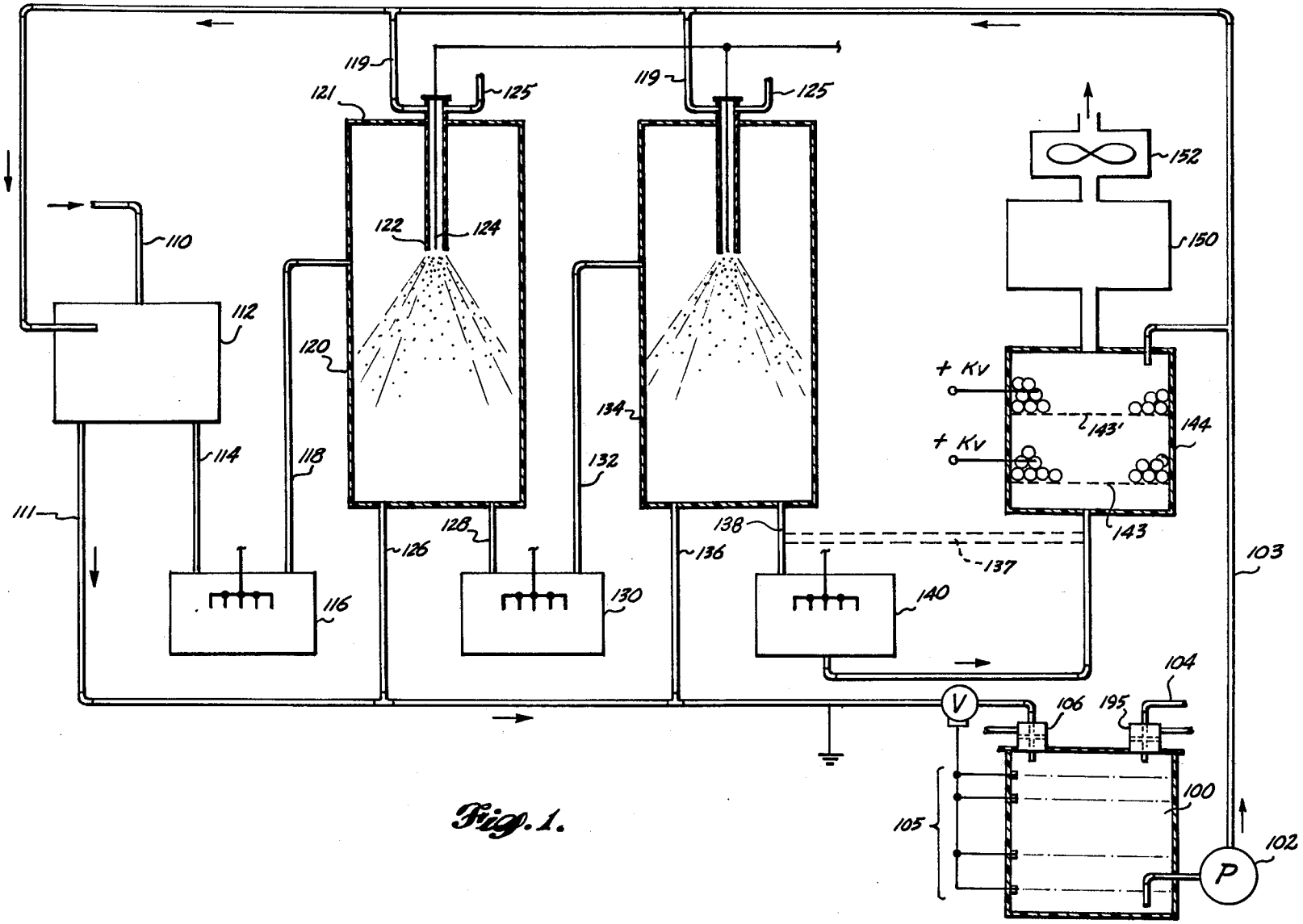
FIG. 1 is a generalized flow diagram of an electrostatic scrubber and collector system.

Wet Electrostatic Scrubber Using One or More Spray Towers in Series with Bubble-Forming Gas-Liquid Contactor In FIG. 1, a schematic flow diagram of a wet electrostatic scrubber system including features of this invention is illustrated. The system shown includes an aerosol entering the system through conduit 110 from a source (not shown), such as the exhaust gas from a coal-fired, power boiler, a metallurgical kiln, a pulp mill recovery boiler effluent or the like, containing a substantial loading of aerosol particles. This gaseous dispersion is passed into an initial liquid contacting chamber 112 which functions to cool the incoming gas if necessary and provide an initial contact of the gases with a spray of the liquid used to wash the gas. This interaction between the washing liquid and the gas may or may not be conducted with the aid of an electrostatic charge on the liquid. The liquid not evaporated in the cooling process is drained and returned to the sump 100 through drain 111.

Gases leave the cooling chamber 112 through conduit 114 and enter the particle-charging zone 116. A suitable structure for the particle-charging zone 116 is an electrostatic precipitator, well-known in the art. A portion of the particulate material may be removed in the particle-charging zone 116 and the gases containing a substantial portion of the aerosol leave through conduit 118 and are injected into a spray tower 120 which is designed to intermix the aerosol containing gases with droplets of cleansing liquid injected into tower 120 through spray nozzle 122. The droplets thus carry an electrostatic charge opposite in polarity to that charge imposed upon the aerosol particles in the particle-charging zone 116. As shown in FIG. 1, the cleansing liquid is supplied through line 119 and enters the tower 120 through the top 121 and is discharged into the spray tower through nozzle 122. A high voltage lead 124 is positioned either in the liquid conduit or projecting outwardly from the nozzle to impose an electrostatic charge on the liquid droplets. Purge air to the nozzle area is supplied through purge air line 125 to keep the pipe to nozzle dry, so that is will not short out to the wall of tower 120 or to the tower top 121. The aerosol particles are then attracted to the charged droplets according to Coulomb's Law, some are captured by the droplets and removed through the drain 126. While many particles are removed by this first spray tower 120, tiny particles of aerosol tend to carry over in the gas stream, leaving the spray tower through conduit 128. This aerosol gas-containing gas stream is then passed through a second aerosol charging zone 130 where a negative potential is imposed upon the aerosol particles and then passed into a second spray tower 134 through conduit 132. Spray tower 134 is a similar structure to spray tower 120 and functions in a substantially identical manner. Liquid containing certain additional quantities of the aerosol particles is drained out through drain 136 and the washed gases leave the tower 134 through conduit 138. Again these gases contain a certain quantity of the aerosol particles which have not as yet been removed from the gas stream in the first and second spray towers, as well as a fog or dispersion of small liquid droplets. The aerosol containing gases are then passed into bubble scrubber 144 directly through conduit 137 or the gas stream may again be charged in particle-charging zone 140 and then passed into bubble scrubber 144. A liquid containing a high electrostatic charge opposite to that charge carried by the aerosol particles is passed counter-currently (downwardly) to the flow of the gases in the bubble scrubber 144. A bubble generator 143, in the form of a perforated plate or other gas-liquid contacting device is utilized to promote intimate gas-liquid contact. The gases passing through the bubble plate structure cause the liquid resting on top of the bubble plates to foam and the gases are encapsulated within bubbles or are collected on bubbles formed in the process. The liquid may drain slowly down through the perforated plate 143 or may be taken off of the plate and recycled through the particle removal system (i.e., settling tank). The resulting close proximity of the charged particles to the electrostatically charged surface film forming the bubble, coupled with the long residence time obtained by a bubble plate device enhances the capture characteristics of the system whereby the difficult-to-remove aerosol particles are captured with a substantially improved efficiency. Gases then pass out through a mist eliminator 150 through exhaust fan 152 and then discharged to the atmosphere.

The liquid is supplied to the towers and the bubble scrubber by pump 102 through the conduit system shown. Pump 102 removes liquid from sump 100 which has level controls 105 installed therein to control the level of liquid. Fresh water makeup 104 is injected through isolation injector 195 to prevent flow of electrical current into the supply lines for fresh water makeup. Similarly, the recycled liquid enters sump 100 through isolation injector 106 to prevent flow of current through the recycle lines.

Sump 100, pump 102 and conduit 103 are maintained at an elevated voltage, usually positive, and must be insulated and isolated from the rest of the system. This is best accomplished by the use of nonconductive materials of construction for those parts which contact the liquid.

Figure 2:
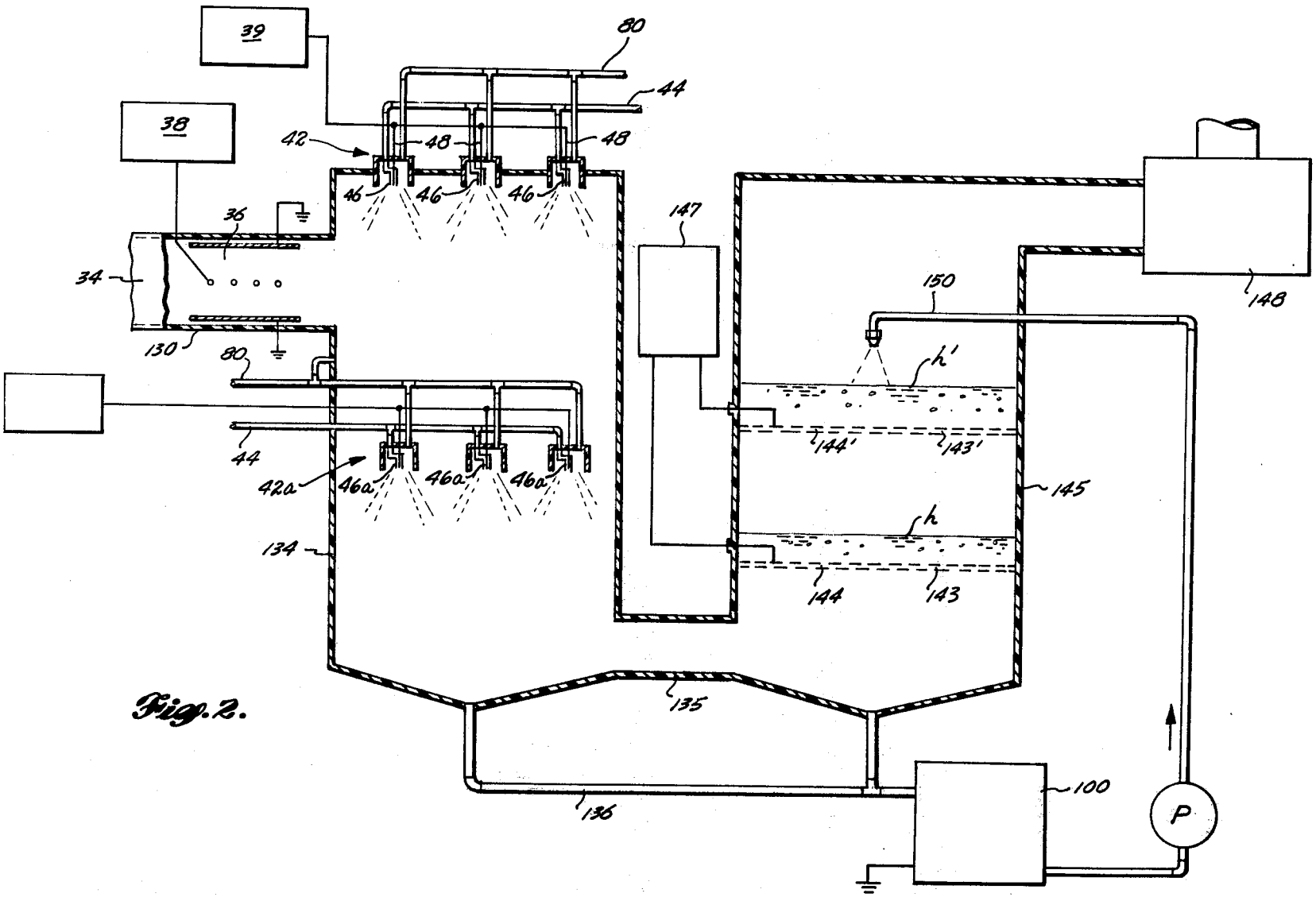
FIG. 2 is a schematic cross section of one spray tower and a charged droplet bubble scrubber.

In FIG. 2, one spray tower 134 and bubble scrubber 145 are schematically shown. The aerosol containing gases, such as those emitted from a coal-fired power boiler, enter at gas inlet 34 and pass through an aerosol particle charger 36 operated by a high voltage power supply 38 imposing a negative, high voltage direct current upon the electrostatic charger. The particulate matter in the gases receives a strong electrostatic charge from electrodes 76 and the charged gases are then directed into the spray tower 134.

Located above the gas entrance is a liquid spray electrostatic charging means 42 used to impose a high voltage upon liquid droplets formed therein. The power supply 39 provides a high voltage current to the charging means 42. A cleansing liquid enters through pipe 44 and continues on to the spray nozzles 46. Insulated high voltage leads 48 extend into the liquid near the spray nozzles 46. Leads 48 are uncovered at their ends in the pipes 44 near the spray nozzles 46. Through the interior of the charging means 42, clean dry purge air is directed from pipe 80 as a purge to protect the nozzles 46 and the exposed pipe 44 from deposits of substances which may cause arcing, electrical short circuiting, or other malfunction of the droplet charging system.

Spray tower 134 is preferably constructed of a material having insulating properties, such as fiberglass reinforced polyester, epoxy resins, ceramics or other suitable material which provides both the insulating properties necessary and the resistance to corrosion to the particular system being employed. By having the tower structure itself constructed of an insulating material, the electrostatically charged droplets and particles tend less to migrate to the walls, and, as a consequence, remain in the area in which the maximum contact between the charged aerosol containing gases and liquid droplets is achieved.

The spray tower 134 is shown equipped with an auxiliary spray means **42*a* to inject additional electrostatically charged droplets of cleansing liquid through nozzles 46*a*. Some of the larger droplets injected at spray means 42 and 42*a* may settle out and be collected at the bottom of tower 134. Liquid is returned to the sump 100 by drain line 136. The remainder of the liquid is carried over into charged droplet bubble scrubber 145 in the form of a fog or tiny droplets of liquid, each having an electrostatic charge thereon. The gases carrying any remaining charged aerosol particles and the liquid droplets noted above pass from tower 134 into scrubber 145 through duct 135. A pair of perforated bubble plates 143 and 143' are positioned horizontally within bubble scrubber 145. Both plates are sized so that gases may flow upwardly through the perforations 144 and 144' therein while liquid flows slowly downwardly through the perforations. A substantial liquid level h and h' is maintained on top of each perforated plate during operations by injection of a flow of liquid through supply pipe 150. Gases flowing upwardly through the perforations form small bubbles in the liquid and as a result are in intimate contact therewith. The liquid is charged to a high voltage by power supply 147 and as a result, the charged particles and droplets are collected in the film forming the bubbles. The gases, cleansed of the particles, pass out through mist eliminator 148** to the atmosphere.

Figure 4:
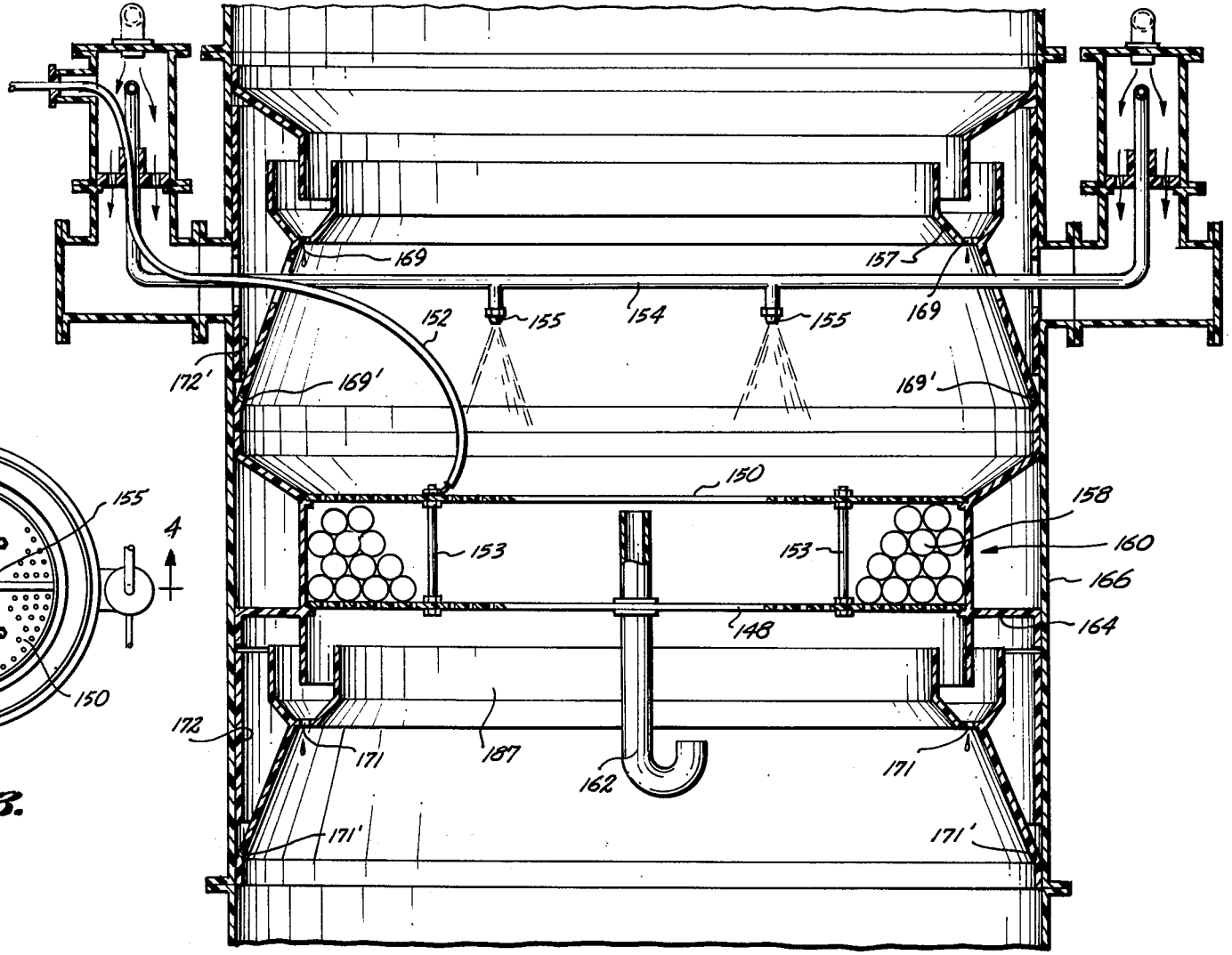
FIG. 4 is a cross sectional view taken along lines 4—4 of FIG. 3, showing the interior elements of the electrostatic bubble scrubber.
Figure 3:
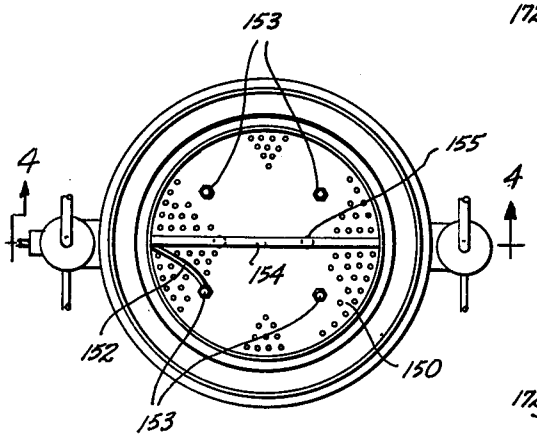
FIG. 3 is a plan view of one embodiment of an electrostatic bubble scrubber.

FIGS. 3 and 4 show one preferred embodiment of the charged droplet bubble scrubber device. FIG. 3 is a plan view showing the upper perforated plate 143' having high-voltage supply cable 152 connected thereto. The high-voltage supply cable is attached to one of the four plate spacers 153. The liquor-feed supply conduit 154 carries a plurality of spray nozzles 155. Electrostatic isolating baffles 157 and 187 serve to prevent the high voltage imposed upon the scrubber from being grounded out through the walls of the device.

In the scrubber zone, best seen in FIG. 4, a packed column area 160 is comprised of a pair of parallel spaced-apart perforated metal bubble plates 148 and 150. These bubble plates are spaced apart by plate spacers 153 and may contain packing 158, if desired, to increase the gas-liquid contact area. An overflow drain downcomer 162 permits liquid flow from the packed portion of the scrubber section to the drain. During operation, a head of water is maintained in the overflow drain, so that air does not pass upwardly through the drain. The assembled plates are nestled within the bubble plate support 164, which is preferably constructed of a nonconducting material, such as fiberglass reinforced polyester, other plastic substance, or a ceramic. Bubble plate support 164 serves to position the bubble plate assembly 160 in a spaced-apart relationship with the shell 166. High-voltage cable 152 serves to maintain the bubble plate assembly and the liquid contained therein at a suitably high potential, thus imposing an electrostatic charge upon the liquid contained therein. In the embodiment shown, the liquor supply is electrically isolated from the high-voltage bubble plate assembly and is grounded.

In operation, liquid is fed to the bubble plate assembly through liquor feed supply conduit 154 onto upper perforated plate 150. Simultaneously, gases containing particulate matter are caused to flow upwardly through lower perforated plate 148 and upper perforated plate 150. The counter-current flow of liquid and gas cause the formation of bubbles at plates 148 and 150 with the resultant formation of a foam of substantial depth on each plate. The packing 158 serves to further provide additional surface for contact of the gas and liquid. The gas containing an electrostatically charged aerosol is thus intimately contacted with the liquid having an opposite charge. Following Coulomb's Law, the particulate matter is attracted to and captured by the liquid. Since tiny bubbles are formed and intimate contact results, a very substantially improved collection efficiency is thus obtained. The liquid which is fed to the upper surface of upper perforated plate 150 passes downwardly through the perforations into the packed intermediate zone containing packing 158 and continues to travel downwardly to plate 148. The influence of upwardly flowing air slows the downward progress of the liquid and, at steady state conditions, a mass balance is achieved with slowed downward flow of liquid and upward flow of aerosol-containing gases. When the level of liquid in the zone between plates 148 and 150 reaches the upper level of overflow drain downcomer 162, the liquid is free to flow downwardly through the drain. This prevents flooding of the packed section of the bubble scrubber 160.

Isolating baffle 157 prevents flow of liquids to the shell 166. Drainholes 169 and 169' in the upper isolated baffle serve to drain any liquid which may flow through the shell area. Liners 172 and 172' are made of polytetrafluoroethylene or other material which is resistant to wetting may be used to aid in electrically isolating the system and to aid in maintaining the system as clean as possible.

The lower isolating baffle 187 similarly serves to isolate the system electrically and drainholes 171 and 171' permit excess moisture to drain back into the interior of the scrubber section. The isolating baffles are constructed of an insulated substance, such as fiberglass reinforced polyester, other suitable plastics or ceramic materials.

In describing the multiple spray tower wet electrostatic scrubber illustrated in FIG. 1, reference was made to the corona discharge aerosol particle-charger 36. In the schematic view of FIGS. 5 and 6, an arrangement of the corona wire frame 74 of discharge electrodes 76 is shown in its relative position to the collection plates 78 serving as the non-discharge electrodes. The corona discharge electrodes 76 are preferably formed in a helix as shown to increase the available surface for corona and thereby to enhance the effectiveness of the particle charging functions of the apparatus.

Also in describing the wet electrostatic scrubber illustrated in FIG. 1, reference was made to a droplet-charger 42. In FIGS. 7 and 8, one embodiment of a cleansing liquid droplet-charger 42 is illustrated. FIG. 7 indicates the positions of the nozzles 46 in the spray tower 32 with their respective insulators 50, liquid supply pipes 44, purge air ducts 80, and high voltage leads 48. In FIG. 8, taken on line 8—8 of FIG. 7, part of the components of the direct wire or direct voltage droplet charger 42 are illustrated in a partial cross section. The cleaning liquid is directed downwardly into pipes 44, then charged at uncovered end 81 of high voltage leads 48, and thereafter emitted through the spray nozzles 46 as electrostatically positively charged droplets 82 ready to start their scrubbing function. It is to be noted that nonconductive piping 44 for the liquid is preferred to reduce the loss of electrical energy.

One embodiment of this Wet Electrostatic Scrubber, schematically illustrated in FIGS. 2 and 3, involves the effective use of both electrostatically charged liquid droplets and electrostatically charged liquid bubbles to collect oppositely charged aerosol particles, for example from contaminated aerosol gases enroute to and/or up an exhaust stack. The charged liquid droplets may be of either equal or opposite polarity from the bubbles of cleansing liquids.

The corona wires are connected to a high-voltage power supply and ionize the gases and incoming aerosol particles. The non-discharge electrodes are connected to ground. The cleansing liquid droplets are generated by discharging liquids under pressure from spray nozzles, or by discharging liquids, not under pressure, but in the presence of flowing air under pressure, as occurs when a pneumatic nozzle is used.

The liquid electrostatic charge is imparted by a corona generator which is connected to a high-voltage power supply. The spray tower chamber walls are constructed of either conductive or nonconductive materials, or a combination of them. The liquid supply lines are made of nonconductive materials, and they are connected to the chamber walls by using fittings that provide for the entry and discharge of dry clean air which purges the volume around the nonconductive material, serving to keep the nonconductive supply line materials and some other materials dry and, therefore, substantially free of insoluble deposits.

The charged aerosol particles and the oppositely charged cleansing liquid droplets flow through perforated plate 148, which is made from a conductive material. This perforated plate 148 contains a plurality of apertures 144 through which the gases, aerosol particles, and liquid droplets entrained in the gases flow. The gas, particle and droplet mixture then bubbles through a layer of liquid and foam maintained at a level h on top of perforated plate 148. The liquid flows countercurrently to the gases downwardly through apertures 144. The liquid may contain a foaming agent or surfactant to assist in the generation and stabilization of the bubbles, thereby increasing the contact time between the liquid and the aerosol containing gases.

In the embodiment shown in FIG. 2, the foam is raised to a positive polarity in the range of 30 KV by the power supply 147. The flow rates of the liquid and gases through the gas-liquid contactor 145 are regulated so that the two phase gas-liquid foam on top of the perforated plate 143 and 143' is maintained at a depth of from about 2 to about 24 inches. The gases flow upwardly through the apertures 144 and 144' and the liquid flows downwardly through the same apertures, providing excellent gas-liquid contact.

The charged aerosol particles are collected upon the surfaces charged to the opposite polarity, which are the surfaces on either or both of the liquid droplets or the bubbles. Aerosol particle collection will occur upon both the inside and outside surfaces of the respective bubbles. The liquid and foam maintained at a given level upon the perforated plate is electrostatically charged by a high voltage power supply to a polarity either the same or opposite from the liquid droplet, and to a polarity either the same or opposite from the aerosol particles.

Figure 9:
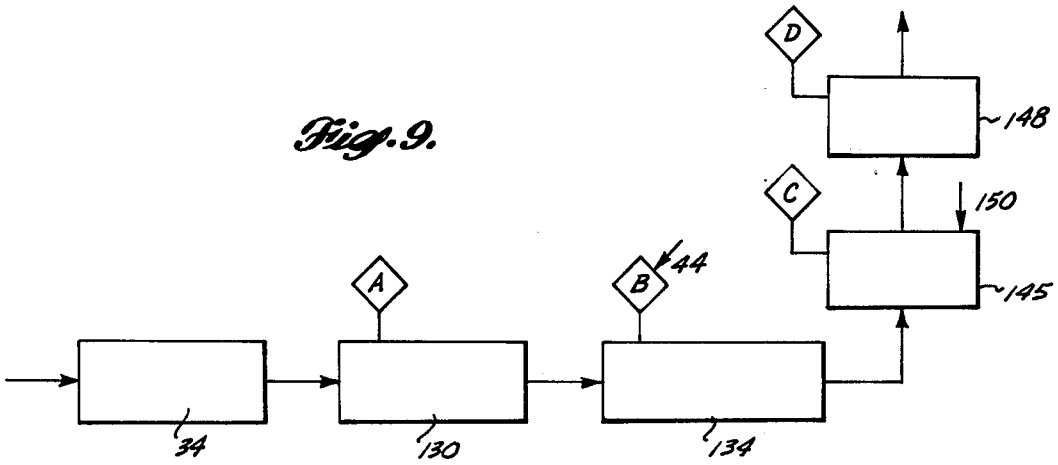
FIG. 9 is a schematic diagram indicating polarities of electrostatic charges imposed at various locations of the electrostatic scrubber for differing operating conditions.

In FIG. 9 a schematic representation of the gas flow and electrostatic charge modes useful in this invention is shown. Aerosol-containing gases enter the apparatus through conduit 34 and flow into charging section 130. An electrostatic charge is imposed thereon. Liquid enters tower 134 with an elctrostatic charge and enters bubble scrubber 145 maintained at an elevated potential. Liquid is removed from the gas stream in precipitator 148. The workable polarities and electrostatic charging voltages are set forth in Table 1.

TABLE I

| Condition | A Corona Section | B Spray Tower | C Bubble Scrubber | D Mist Eliminator | Figure |
|---|---|---|---|---|---|
| I | −30 to −400 kv | +1 to 50 kv | +1 to 50 kv | +30 to 100 kv | 10 |
| II | −30 to −400 kv | −1 to 50 kv | +1 to 50 kv | +30 to 100 kv | 11 |
| III | −30 to −400 kv | +1 to 50 kv | −1 to 50 kv | −30 to 100 kv | 12 |
| IV | +30 to +400 kv | +1 to 50 kv | −1 to 50 kv | −30 to 100 kv | 13 |
| V | +30 to 400 kv | −1 to 50 kv | −1 to 50 kv | +30 to 100 kv | 14 |
| VI | +30 to 400 kv | −1 to 50 kv | +1 to 50 kv | +30 to 100 kv | 15 |

For each mode of operation set forth in Table I, reference is made to FIGS. 10–15 which show schematically the conditions in bubble scrubber 145.

Figure 10:
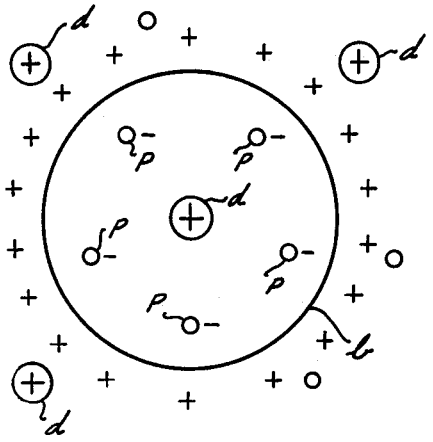
FIGS. 10–15 are enlarged schematic cross sections of respective individual combinations of droplets, aerosol particles and bubbles showing, respectively, obtainable dispersements of electrostatic charges for the conditions shown in FIG. 9 for the cleansing liquid droplets, the charged aerosol particles, and the bubble structures.

In FIG. 10, the bubble b is charged positively and is shown surrounded by liquid. The droplets are charged positively while the particles are charged negatively. Thus the negatively charged particles are attracted to the inside and outside surfaces of the positively charged bubble and are further attracted to the positively charged droplet. Thus the particles are collected upon both the droplets and the surfaces of the bubble.

Figure 11:
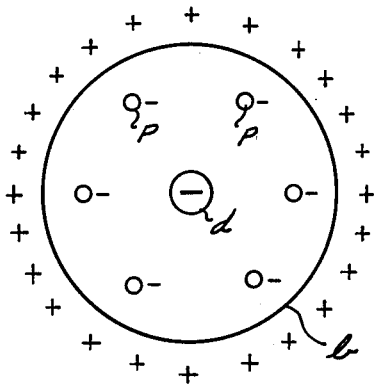

In FIG. 11, the bubble b is charged positively and is shown surrounded by liquid. The particle p is charged negatively, and the droplet d is charged negatively. The negatively charged particles are repelled by the negatively charged droplet, which is located inside of the bubble, and are attracted to and collected upon the positively charged inside surface of the bubble.

Figure 12:
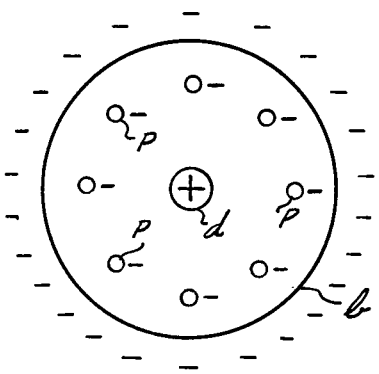

In FIG. 12, the bubble is charged negatively, and is shown surrounded by liquid. The droplet is charged positively, and particles are charged negatively. The negatively charged particles are repelled by the negatively charged bubble surface and are attracted to the positively charged droplets.

Figure 13:
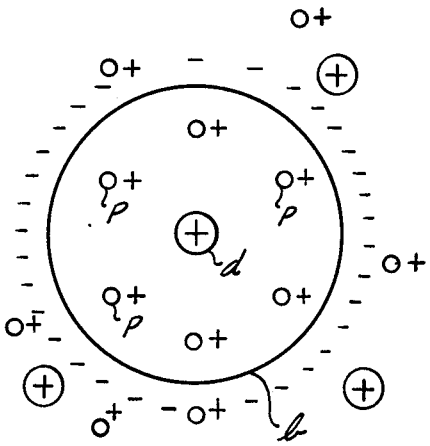

In FIG. 13, the bubble is charged negatively, the droplets are charged positively and the particles are charged positively. The particles are repelled by the droplets and attracted by the inside and outside surfaces of the bubble.

Figure 14:
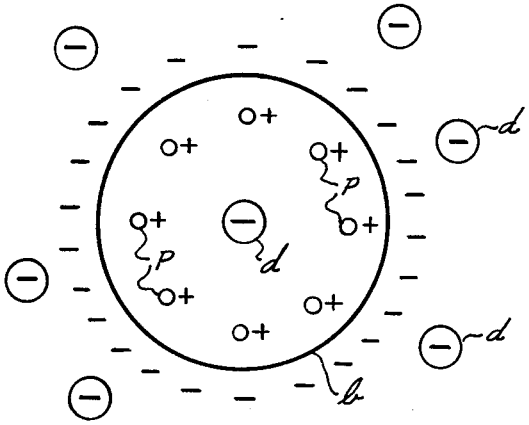

In FIG. 14, the bubble is negatively charged, the droplets are negatively charged and the particles are positively charged. Both the droplets and the bubble inside and outside surfaces attract the particles.

Figure 15:
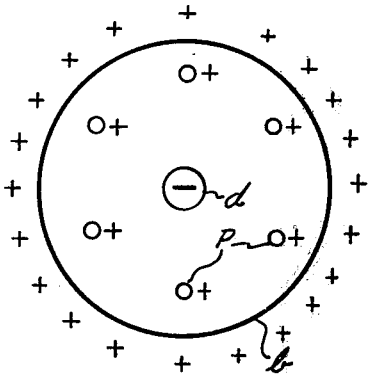

In FIG. 15, the bubble is positively charged. The droplets are negatively charged and the particles are positively charged. Particles are repelled by the bubble surface and attracted to droplets.

The following operating parameters have been found workable by the inventor for the overall system shown in FIGS. 1 and 2:

1. Power supply to corona section 116 or 130—30 to 400 kilovolts.
2. Power supply to water or liquor bubble section 145—1 to 50 kilovolts.
3. Power supply to water or liquor spray section 134—1 to 50 kilovolts.
4. Water flow to water or liquor spray section 134—0.1 to 50 gallons per 1,000 actual cubic feet of gas.
5. Water flow in bubble sections 145—0.1 to 50 gallons per 1,000 actual cubic feet (water can be recycled).
6. Gas flow rate in spray towers—1 to 30 feet per second.
7. Gas flow rate in bubble sections—1 to 20 feet per second.
8. Gas flow rate in corona sections 130—1 to 50 feet per second.

Figure 16:
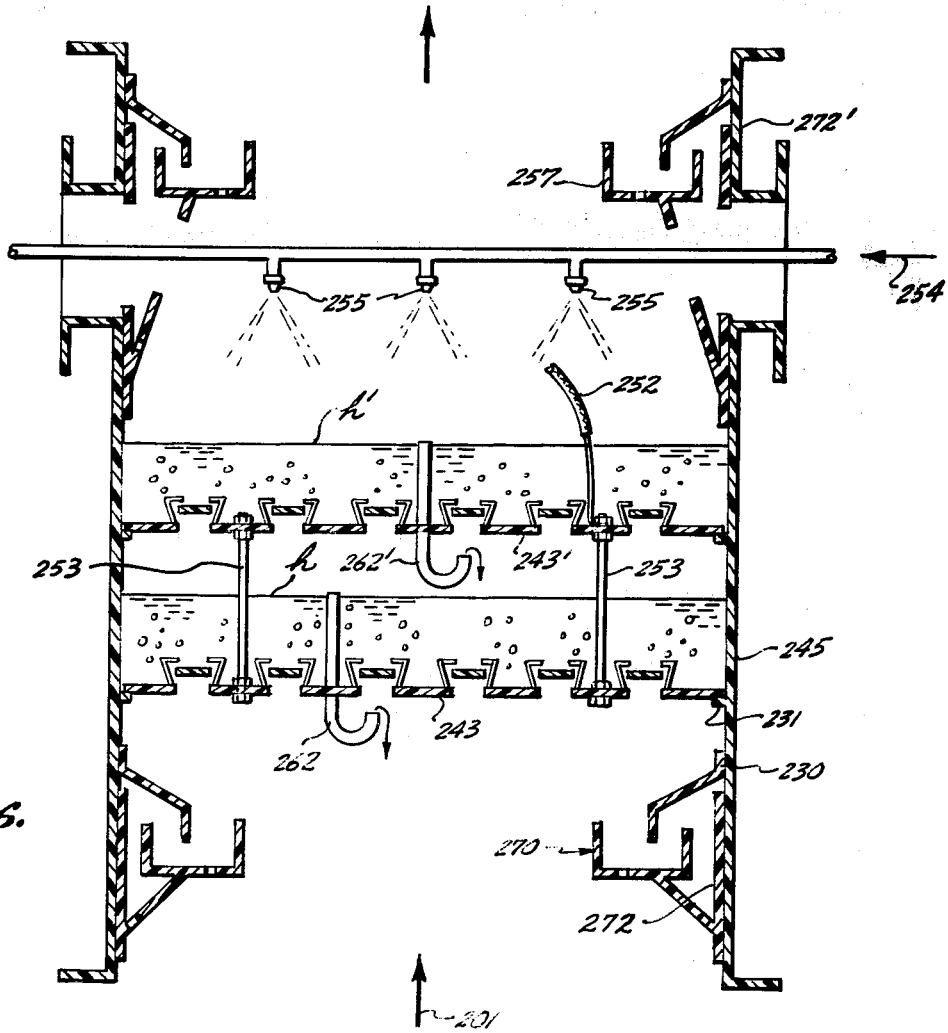
FIG. 16 is an axial, cross sectional view of another embodiment of an electrostatic bubble scrubber.

In FIG. 16, there is seen a second embodiment of the charged bubble scrubber which is operatively positioned downstream of both a particle-charging section and the charged droplet spray tower 134 (not shown). The charged bubble scrubber 245 is similar to the device shown in FIGS. 1 and 2. In this embodiment, the aerosol-containing gases, after having been charged in an aerosol particle-charger (not shown), enter the bubble scrubber in the direction shown by arrow 201, the particulate matter in the gases having a strong electrostatic charge imposed thereon by the aerosol particle-charger. The gases are preferably passed through a liquid spray tower prior to entering bubble scrubber 245, so that a fog of tiny droplets, having received an electrostatic charge in the spray tower, are carried over with the aerosol-containing gases into bubble scrubber 245. An upper bubble plate 243' and a lower bubble plate 243 are shown positioned axially within a cylindrical shell 230. The plates are supported on a annular rib 231 and are spaced apart from each other by spacers 253. Downcomers 262 and 262' permit liquid to flow from the upper surface of the plate downwardly to the subjacent plate or out of the system. Liquid is maintained at a level h and h' on plates 243 and 243', respectively. A high-voltage cable 252 is shown connected directly to one of the plate spacers 253 and has imposed thereupon a high voltage in the range of 1 to 50 kilovolts DC. Several of the bubble plates may be stacked serially one upon the other to provide the necessary amount of gas-liquid contact.

The washing liquor is supplied from a grounded sump source through liquor supply pipe 254 and enters the charged bubble scrubber through nozzles 255. The nozzles are positioned sufficiently above the uppermost plate so that electrical isolation between the liquor supply 254 and the plate is maintained. The flow of liquor to the plates will be at such a rate such as to maintain a predetermined level above the plate. Drainage from the upper plate 243' feeds the lower plate 243 so that a sufficient head is maintained on lower plate 243. The level of liquid on each plate assumes a maximum governed by the location of the overflow drain downcomer 262. Charging of the liquor on the bubble plates is accomplished by imposing a high voltage on cable 252. Since the plates are constructed of conductive material, such as stainless steel, the voltage imposed upon upper plate 242' is conducted to the lower plate 243, so that all of the liquid on each of the plates is maintained at a high voltage. As the air stream is forced up through the bubble plates, the charged liquor will attract and remove the entrapped, oppositely charged particles, as well as absorbing soluble gases and capturing the charged water droplets entrained in the gases.

The shell 230 of the charged bubble scrubber is constructed of a nonconductive substance, such as a fiberglass reinforced polyester, other suitable plastic materials or ceramics. The baffles 270 and 257 each serve to isolate the charged bubble scrubber from adjacent zones of the apparatus. This is necessary so that a high voltage may be maintained in the bubble scrubber zone which is opposite in polarity to the high voltage imposed upon the particles at other locations in the apparatus. Preferably the charged bubble scrubber walls will be lined with a Teflon liner 272 to aid in maintaining the electrical isolation.

The embodiments of the invention in which an exclusive property or privilege is claimed are defined as follows:

1. A method of removing aerosol particles from a flowing gaseous stream comprising the steps of:

imposing a first electrostatic charge upon the particles contained in said flowing gaseous stream;

contacting the flowing gaseous stream with a spray of liquid, the droplets forming said spray having a second electrostatic charge thereon differing in potential from said first electrostatic charge, whereby a portion of said aerosol particles is collected upon said liquid droplets;

removing at least a portion of said liquid droplets upon which said aerosol particles have been collected from said gaseous stream;

passing said gaseous stream containing a reduced quantity of aerosol particles therein, and entrained liquid droplets, into a bubble-forming gas-liquid contact apparatus, wherein said gaseous stream forms bubbles and is intimately intermixed with scrubbing liquid supported upon said bubble-forming apparatus, said scrubbing liquid having a third electrostatic charge thereon opposite in polarity to said first electrostatic charge, whereby said particles and said liquid droplets are captured and removed from said gaseous stream; and exhausting the scrubbed gaseous stream from said bubble-forming apparatus.

2. A method of removing contaminant aerosol particles from emission gases comprising:

imposing a first electrostatic charge upon said particles;

imposing a second electrostatic charge upon a cleansing liquid, said second electrostatic charge being of a potential differing from said first electrostatic charge placed upon said aerosol particles;

dispersing said cleansing liquid into droplets within said emission gases whereupon at least some of the particles are collected by said droplets;

flowing the emission gases containing at least a portion of said charged aerosol particles and said charged cleansing liquid droplets through an electrostatically charged bubble-forming apparatus, said apparatus having a cleansing bubble-forming liquid thereon, said bubble-forming liquid having a third electrostatic charge of a polarity opposite from the electrostatic charge on said aerosol particles and at a potential differing from said second potential, whereby the charged contaminant aerosol particles and the charged liquid droplets are attracted to and collected by the charged bubble-forming liquid.

3. A method of removing contaminant aerosol particles from emission gases comprising:

imposing a first electrostatic charge upon entrained contaminant aerosol particles in said emission gases;

imposing a second electrostatic charge of the same polarity but at a different potential level from said first electrostatic charge upon a cleansing liquid;

injecting said cleansing liquid as droplets into said emission gases;

flowing the emission gases with the charged aerosol particles and a portion of said charged cleansing liquid droplets through an electrostatically charged bubble-forming unit having a cleansing, bubble-forming liquid therein, said emission gases being the gaseous phase within liquid bubbles formed in said bubble-forming unit, the cleansing, bubble-forming liquid being electrostatically charged to a polarity opposite from both the first electrostatic charge on the aerosol particles and the second electrostatic charge on the cleansing liquid droplets, whereby the charged contaminant aerosol particles positioned within the charged bubbles are repelled by the charged droplets and attracted to and collected by the inside surface of the charged bubbles;

and collecting any remaining droplets of cleansing liquid from said emission gases in a mist collector means positioned downstream of said charged bubble-forming unit.

4. An electrostatic wet scrubber and collector assembly comprising:

means defining a spray chamber having an inlet and an outlet;

means positioned and arranged with respect to said spray chamber to impose a first electrostatic charge upon particulate matter contained in a gaseous stream entering said spray chamber;

liquid spray means in said spray chamber to inject droplets of a liquid into said chamber and means to impose on said droplets a second electrostatic charge of a differing potential from said first electrostatic charge, whereby said gaseous stream contains charged liquid droplets and charged particulate matter which are attracted toward each other;

a bubble scrubber means in fluid communication with said spray chamber having means to receive said gaseous stream from the outlet of said spray chamber and to cause said gaseous stream to flow upwardly, said bubble scrubber means comprising at least one bubble-forming means for supporting a bubble-forming liquid thereon positioned within a vertical tower;

means positioned and arranged with respect to said bubble scrubber means to impose a third electrostatic charge on said bubble-forming liquid; said third electrostatic charge being of a polarity opposite to at least one of said first and said second electrostatic charges;

means positioned and arranged with respect to said bubble-forming means to recycle said bubble-forming liquid including a sump and pump means.

5. The apparatus of claim 4 wherein said sump and pump means are maintained at an elevated voltage.

6. The apparatus of claim 4 wherein said bubble-forming means comprises a plurality of bubble-forming trays, each of said bubble-forming trays having perforations therein for upwardly directed passage of gaseous matter and downwardly directed passage of liquid.

7. The apparatus of claim 4 wherein said bubble scrubber means comprises a packed tower.

8. The apparatus of claim 4 wherein said bubble scrubber means is electrically isolated from said tower.

9. The apparatus of claim 4 wherein said sump and pump means is electrically insulated to isolate said sump and pump means from the surrounding area and wherein said sump and pump means is maintained at said third electrostatic potential.

10. The apparatus of claim 4 wherein said sump and pump means is electrically isolated from said bubble scrubber means.

11. A charged bubble scrubber comprising:

a nonconductive shell having an entrance for charged aerosol-containing gases and an exit for cleansed gases;

a bubble-forming tray means positioned within said shell, said tray means having apertures therein for upward flow of said charged aerosol-containing gases, said tray means being electrically isolated from ground;

means to impose a high voltage upon said tray means;

means to supply a cleansing liquid to said tray means including means to electrically isolate said supply means from said tray means; and electrical isolation baffles constructed of insulating material, and positioned and arranged in said shell for preventing said liquid from contacting said shell at said entrance, said baffles comprising an inwardly sloping liquid draining surface to direct the liquid inwardly and downwardly of the shell at said entrance.

12. The apparatus of claim 11 wherein said means to supply cleansing liquid comprises a sump, a pump, distribution conduit, recycle conduit, water makeup, sump level controller and electrical isolation means for said recycle conduit and said water makeup, wherein said sump, pump and distribution conduit are maintained at the elevated voltage imposed upon said tray means.

13. The apparatus of claim 11 wherein said means to supply cleansing liquid is electrically isolated from said tray means and is grounded.

14. The apparatus of claim 11 further including electrostatic precipitator means positioned downstream of and coupled to said exit for cleansed gases to remove liquid droplets from said cleansed gases.

15. A method for removing aerosol particles from a flowing gaseous stream comprising the steps of:

passing said flowing gaseous stream into chamber means defining a spray chamber and a bubble scrubber chamber, in said chamber means imposing a first electrostatic charge upon the particles contained in said flowing gaseous stream and removing from said chamber means at least a portion of said particles having said first electrostatic charge, in said spray chamber contacting the flowing gaseous stream with a spray of liquid, the droplets forming said spray having a second electrostatic charge differing in potential from said first electrostatic charge, whereby a portion of said aerosol particles are collected upon said droplets, and removing from said spray chamber at least a portion of said liquid droplets upon which said aerosol particles have been collected, in said bubble scrubber chamber contacting said flowing gaseous stream with a bubble-forming liquid having a third electrostatic charge therein differing in potential from at least one of said first and second electrostatic charges, wherein said flowing gaseous stream forms bubbles and is intimately intermixed with the bubble-forming liquid and whereby at least a portion of said aerosol particles are captured by said bubble-forming liquid and are removed from said flowing gaseous stream, and removing from said bubble scrubber chamber at least a portion of said bubble-forming liquid containing said aerosol particles, and exhausting said flowing gaseous stream from said particle removing chamber means.

16. The method of claim 15 wherein said third electrostatic charge has a different polarity from at least one of said first and second electrostatic charges.

17. The method of claim 15 wherein said gaseous stream is contacted with said spray of liquid after said first electrostatic charge is imposed upon the aerosol particles in said gaseous stream.

18. The method of claim 15 wherein said gaseous stream is contacted with said bubble-forming liquid after being contacted with said spray of liquid.

19. An electrostatic wet scrubber and collector assembly comprising:

chamber means defining a spray chamber and a bubble scrubber chamber, said spray chamber and said bubble scrubber chamber being in gaseous communication with each other, said chamber means having an inlet and an outlet, means positioned and arranged with respect to said chamber means for imposing a first electrostatic charge upon particulate matter contained in a gaseous stream passing through said chamber means from said inlet to said outlet, spray means associated and arranged with respect to said spray chamber for injecting droplets of liquid into said spray chamber, and means associated with said spray means for imposing a second electrostatic charge on said droplets said second electrostatic charge differing in potential from said first electrostatic charge, whereby said droplets and particulate matter are attracted to each other, means associated and arranged with respect to said spray chamber for removing at least a portion of said droplets to which particulate matter has been attracted, bubble scrubber means associated and arranged in said bubble scrubber chamber to receive said gaseous stream passing through said chamber means and to cause said gaseous stream to flow upwardly through said bubble scrubber chamber, said bubble scrubber means containing at least one bubble-forming means for supporting a bubble-forming liquid thereon, said bubble scrubber means being positioned to receive said gaseous stream as it flows upwardly through said bubble scrubber chamber, means positioned and arranged with respect to said bubble scrubber means for imposing a third electrostatic charge on said bubble-forming liquid, said third electrostatic charge having a potential different from at least one of said first and second electrostatic charges, and means, including a sump and a pump, positioned and arranged with respect to said bubble-forming means for recycling said bubble-forming liquid from the bubble scrubber means to said sump and back to said bubble-forming means.

20. The assembly of claim 19 wherein said means for imposing said third electrostatic charge imposes a charge which has a different polarity from at least one of said first and second electrostatic charges.

21. The assembly of claim 19 wherein said spray chamber and said bubble scrubber are serially arranged so that a gaseous stream passing through said chamber means will first pass through said spray chamber.

22. The assembly of claim 19 wherein said means for imposing said first electrostatic charge is arranged and positioned with respect to said spray chamber so that said first electrostatic charge is imposed upon said aerosol particles before said gaseous stream enters said spray chamber.

* * * * *

UNITED STATES PATENT AND TRADEMARK OFFICE

CERTIFICATE OF CORRECTION

PATENT NO. : 4,193,774

DATED : March 18, 1980

INVENTOR(S) : Michael J. Pilat

It is certified that error appears in the above-identified patent and that said Letters Patent are hereby corrected as shown below:

Application Data: "Sep. 17, 1978" is changed to --Jul. 19, 1978--.

Signed and Sealed this

*Twelfth* Day of *August 1980*

[SEAL]

*Attest:*

SIDNEY A. DIAMOND

*Attesting Officer*

*Commissioner of Patents and Trademarks*

UNITED STATES PATENT AND TRADEMARK OFFICE

CERTIFICATE OF CORRECTION

PATENT NO. : 4,193,774

DATED : March 18, 1980

INVENTOR(S) : Michael J. Pilat

It is certified that error appears in the above—identified patent and that said Letters Patent is hereby corrected as shown below:

The title page including the the four sheets of drawings should be deleted to appear as per attached.

Signed and Sealed this

*Thirtieth* Day of *December 1980*

[SEAL]

*Attest:*

SIDNEY A. DIAMOND

*Attesting Officer*

*Commissioner of Patents and Trademarks*